United States Patent [19]

Reutler et al.

[11] Patent Number: 4,660,622

[45] Date of Patent: Apr. 28, 1987

[54] METHOD FOR THE MAKING OF MICROCRYSTALLINE METALLIC MATERIALS

[75] Inventors: Harald Reutler, Freital; Wolfgang Löser, Dresden; Heinz Mühlbach, Dresden; Gerhard Richter, Dresden; Günter Stephani, Dresden, all of German Democratic Rep.

[73] Assignee: VEB Rohrkombinat, Stahl und Walzwerk, Riesa, Riesa, German Democratic Rep.

[21] Appl. No.: 701,848

[22] Filed: Feb. 14, 1985

[30] Foreign Application Priority Data

Jan. 26, 1984 [DD] German Democratic Rep. ..... 259617-1

[51] Int. Cl.[4] ..... B22D 11/06

[52] U.S. Cl. ..... 164/463; 164/423; 164/479

[58] Field of Search ..... 164/463, 423, 479, 429, 164/485, 46, 428, 480

[56] References Cited

FOREIGN PATENT DOCUMENTS

| | | | |
|---|---|---|---|
| 24506 | 3/1981 | European Pat. Off. | 164/429 |
| 2909848 | 9/1979 | Fed. Rep. of Germany | 164/428 |
| 57-187149 | 11/1982 | Japan | 164/423 |

*Primary Examiner*—Kuang Y. Lin
*Attorney, Agent, or Firm*—Gabriel P. Katona

[57] ABSTRACT

Apparatus and process for the manufacturing of microcrystalline metallic materials in band form, wherein the chemical compositing for the cooling roller given in ranges within which the upper surface roughness is reduced, the geometry is improved, the presence of microcracks is eliminated or reduced and the ductibility of the band is increased.

6 Claims, No Drawings

METHOD FOR THE MAKING OF MICROCRYSTALLINE METALLIC MATERIALS

The invention relates to the area of metallurgy and is applicable to the manufacturing of metallurgic ready made products, especially in band form having microcrystalline, respectively, define crystalline material structure.

For the continuous manufacturing of strip materials directly from melts, there are apparatus and methods known, such as for example, for the amorphous soft magnetic materials (D. Egami, AIP Conference Procedure, No. 24, 1975, 697) by a rapid solidification on a rotating roller (spinning melting method).

For the manufacturing of strips having amorphous structure according to such process, is characteristic that in a continuous process a perfect geometric form and the achieving of an applicability for the required physical-technical properties can be obtained only in a limited area of technological conditions, which are characteristics for the alloying process used in each case. Regarding the roller material, the requirement for a high heat conductivity at sufficiently good wettability of the roller upper surface will dominate the situation. This lead to the substantial use of copper and copper alloys.

Strips from Fe-materials having microcrystalline structure are obtainable on such rollers not with a sufficiently good band geometry, that is, with a form constant, upper surface roughness and edge formation, as well as free from oxidation (scale and starting coloration). Therefore, for Fe-Cr-Al resistance alloying according to D. Naohara et al (Metal. Trans. 13A 1982, 337) for the manufacturing of bands a steel roller (without the indication of the steel type) is to be used. The produced band possesses, however, a defective geometry, so that, for example, no probes can be produced from it for the mechanical testing. According to H. A. Davies et al (Procedure of the Second Conference on Rapid Solidification Processing, 1980, Reston, USA) during manufacturing of thin bands from Ni-alloys the use of an unalloyed steel is proposed instead of copper for the roller, which will reduce the oxidation on the upper surface of the band, although it will not eliminate it. It is generally known, that the occurrence of oxide layers can be prevented by performing the process under a protective gas or in vacuum. In U.S. Pat. Nos. 4,318,733 and 4,362,553 the production of tool steels is described by means of spinning melting process. The production of conventional tool steels is not possible with the help of such methods, since such steels do not wet the upper surface of the roller (Cu, respectively, CuBe rollers). As a result, there cannot form a stable melt puddle, therefore, undesirable conditions will result for a band formation.

The described tests in these patents show, that the melt jet upon contacting onto the rotating cooling roller, will become deformed, will break off in droplet form and, it will leave the upper surface of the roller in still liquid melt form. As a result, a rapid cooling cannot be realized. A strip production according to the above-mentioned patents becomes possible only if Boron is added between 0.5 and 1.5%. This, on the other hand, is uneconomical since Boron is an expensive alloying element.

It is the aim of the invention to improve the quality of microcrystalline bands from metallic materials produced in a rapid solidification, especially, in spin melting process, and to improve especially their geometry and their upper surface structure and, at the same time, to reduce the costs of performing the process.

It is the object of the invention to employ cooling rollers of appropriate materials and to define the process parameters in dependence from the roller material and from the material to be melted in such a manner, that microcrystalline strips from the metallic materials having an exact geometry and good upper surface characeristics could be produced without working under a protective gas or in vacuum.

According to the invention, the above object is solved in that the roller which is to be used in the rapid solidification process with a spinning melt method or the roller upper surface coming into contact with the melt in a rapid solidification process should be manufactured from a suitable material. As a suitable material, a material should be used which preferably corresponds to the chemical composition of the melt within an error limit of a chemical analysis. Such applicable material for the roller material according to the invention is one which has a chemical composition as follows: for the base metal of the alloy: ±5 weight %, for alloy elements with contents of ±5 weight %: ±10%; for alloy elements with contents of 1-5 weight %: ±20%.

During the maufacturing of microcrystalline strips from a metallic material according to the spinning melt process, the melt is pressed from a jet onto the upper surface of a cooling roller which is set in rotation. Under certain process parameters, on the upper surface of the cooling roller a melt puddle will form, from which due to the heat removal through the roller, a strip will form. For this, it is necessary to match the materials of the roller upper surface with that of the metal to be melted. Furthermore, the process of the formation of the strip with the required properties will be aided by an appropriate temperature of the roller upper surface and by the coordinates of the air rejecting devices and of the band strippers. The air rejecting device or air rejector deflects the air layer from the upper surface of the roller which has been picked up by the roller due to its rotation. The temperature of the roller upper surface will be between 20° C. and 300° C., preferably between 80 and 180. The air rejector will be arranged on about 3-10 mm before the melt puddle. The band stripper will be set according to the required upper surface quality of the band, whereby an increase in the distance between the melt puddle and the band strippers will mean an increase in the after cooling time and, thereby, a reduction of the thickness of the oxide layer on the strip upper surface. In addition, the known, specially defined process parameters, such as the peripheral speed between 5 and 20 m/s, the press out pressure between 5 and 50 kPa and, the spacing between the nozzle and the roller between 0.1 and 0.4 mm, are to be observed.

The essence of the invention rests on the novel recognition, that by using a suitable roller material against other materials, will result in a much improved wetting between the metallic melt and the roller upper surface. By employing the invention, a microcrystalline band for metallic materials can be produced in contrast to the heretofore known state of art of the rapid solidification processes, with a much improved quality.

The use of the invention will result in the following quality improvements:

1. Reduction of the roughness of the band upper and lower side;

2. Improvement of the geometry of the band (homogenous cross section, edge sharpness);

3. Elimination or reduction in the number of the microcracks;

4. Reduction, respectively, a desired setting of the oxidation grade of the bands;

5. Increase of the ductility of the band for certain alloys.

The invention will be explained on hand of the following three special examples:

EXAMPLE 1

Manufacturing of rapid working steel having a microcrystalline structure according to a spinning melt process. The cooling roller possesses a chemical composition in its main components as follows:

Tungsten 6.6 weight %; molybdenum 5.2 weight %; chronium 4.0 weight %; vanadium 2.1 weight %; carbon 0.83 weight %, the rest is iron. The diameter of the roller is 200 mm, the width is 40 mm. The upper surface of the roller possesses a average roughness of ±0.15 μm. For deflecting the air layer carried along during the rotation of the roller, an air rejector is positioned 3 mm before the melt jet contact point.

The alloy to be melted has the following chemical components:

Tungsten 6.35 weight %; molybdenum 5.15 weight %; chromium 3.87 weight %; vanadium 1.98 weight %; carbon 0.82 weight %; the rest is iron.

For the manufacturing of a band according to the above-described process, the following process parameters should be set:

Peripheral speed of the roller: 13 m/s;

Spacing between the nozzle and the roller: 0.15 mm;

Press-out pressure: 25 kPa;

Smelt temperature: 1570° C.

Positioning of the strippers: 450 mm behind the melt jet contact point;

Roller temperature: 120° C.

With the help of such roller made from the specially suitable material and with the help of the defined positioned air rejector, as well as on hand of the above-described specific process parameters, it was possible to produce in air a rapid solidified rapid working steel band having a microcrystalline structure. It is characterized by a very good dimension retention over its length and width. The average band roughness is about <2 μm. The produced band is in addition completely metallic bright. It is remarkable that this steel, due to its high carbon contact, tends to oxidize very strongly in air. Such results can be explained substantially by the good wetting properties of the cooling roller which reflects itself in a very good heat transfer and, also resulting in a leaving temperature of the band from the roller amounting to 540° C., which lies below the critical temperature range of oxidation.

EXAMPLE 2

Alloyed bands have been manufactured which are composed substantially from 14.73 weight % of chromium and 5.44 weight % of aluminum and an iron content of about 79 weight %.

The cooling roller is a composite roller, the base body of which is made from a Cu-alloy and, the upper surface layer of which is made from a material having the following chemical composition in its main components:

About 79% weight Fe; 14.8 weight % chromium and 5.16 weight % aluminium.

The roller has a diameter of about 400 mm and a width of 70 mm. The average roughness of the roller upper surface amounts to ±0.25 μm.

The following process parameters have been set:

Positioning the air rejector 5 mm before the melt jet contact point;

Peripheral speed of the roller: 15 m/s;

Spacing between the nozzle and the roller: 0.2 mm;

Argon gas press-out pressure: 30 kPa;

Temperature of the melt at casting: 1650° C.

Position of the band stripper: 300 mm behind the melt jet contact point;

Roller temperature: 100° C.

With such process parameters on a roller having an upper surface layer made from a suitable material, a metallic bright band of 100 μm thickness has been manufactured in air. Such strip is ductile and possess a good constant of its geometry and edge quality over the entire band length.

EXAMPLE 3

The alloying, the roller material and the process parameters have been the same as in Example 2. By positioning the band stripper between 300 and 100 mm behind the melt jet contact point, the leaving temperature of the strip from the roller has been set between 600° and 900° C. As a result, a desired oxidation of the band has been obtained in an oxygen enriched atmosphere. The pre-oxidation increases the use value of the band made from the heat conducting alloy mentioned in Example 2.

We claim:

1. In a method for the manufacturing of microcrystalline metallic materials in band form by rapid solidification of a melt in a spinning melt process, comprising contacting the melt with a cooling roller of a material the chemical composition of which lies within an admissible limit of analysis error of the chemical composition of the melt, wherein said chemical composition of the individual alloy elements is matching the chemical composition of the melt within the following limits:

for the base metal of the alloy: ±5 weight %;

for alloy elements with contents of 35 5 weight %: ±10%;

for alloy elements with contents of 1–5 weight %: ±20%.

2. The process according to claim 1, wherein the cooling roller comprises at least an upper surface layer and a body portion, and wherein the chemical composition of the upper surface layer corresponds to the composition recited in claim 1.

3. Process for the manufacturing of microcrystalline strips, which employs a cooling roller having the properties according to claim 1 wherein the upper surface temperature of the cooling roller is kept from 20° C. to 300° C.

4. The process of manufacturing of microcrystalline strips, which employs a cooling roller having the properties according to claim 1 wherein the upper surface temperature of the cooling roller is kept from 80° C. to 180° C.

5. The process for manufacturing microcrystalline strips, employing a cooling roller according to claim 1 wherein an air rejecting device is arranged in a distance.

6. The process of manufacturing microcrystalline strips, employing a cooling roller according to claim 1 wherein the leaving temperature of the strip is set by the positioning of a stripper.

* * * * *